US007614847B2

(12) United States Patent
Nelson et al.

(10) Patent No.: US 7,614,847 B2
(45) Date of Patent: Nov. 10, 2009

(54) PATTERN FOR THE SURFACE OF A TURBINE SHROUD

(75) Inventors: Warren Arthur Nelson, Clifton Park, NY (US); Brian Peter Arness, Simpsonville, SC (US); Paul Thomas Marks, Scotia, NY (US); Raymond Edward Chupp, Glenville, NY (US); Tara Easter Mcgovern, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 772 days.

(21) Appl. No.: 10/996,878

(22) Filed: Nov. 24, 2004

(65) Prior Publication Data

US 2006/0110248 A1 May 25, 2006

(51) Int. Cl.
*F01D 11/12* (2006.01)

(52) U.S. Cl. ..... 415/173.4; 415/174.4

(58) Field of Classification Search ..... 415/173.4, 415/174.4

See application file for complete search history.

(56) References Cited

U.S. PATENT DOCUMENTS

| | | | | |
|---|---|---|---|---|
| 4,914,794 | A | 4/1990 | Strangman | 29/889.2 |
| 5,472,315 | A | 12/1995 | Alexander et al. | 415/173.4 |
| 5,756,217 | A | 5/1998 | Schroder et al. | 428/469 |
| 5,951,892 | A | 9/1999 | Wolfla et al. | 219/121.69 |
| 6,171,351 | B1 * | 1/2001 | Schroder et al. | 51/295 |
| 6,350,102 | B1 | 2/2002 | Bailey et al. | 415/173.5 |
| 6,457,939 | B2 | 10/2002 | Ghasripoor et al. | 415/174.4 |
| 6,660,405 | B2 | 12/2003 | Lau et al. | 428/613 |
| 6,887,528 | B2 * | 5/2005 | Lau et al. | 427/448 |
| 7,029,232 | B2 | 4/2006 | Tuffs et al. | |
| 2003/0175116 | A1 | 9/2003 | Le Biez et al. | 415/173.4 |

* cited by examiner

*Primary Examiner*—Edward Look
*Assistant Examiner*—Nathaniel Wiehe
(74) *Attorney, Agent, or Firm*—Cantor Colburn LLP

(57) ABSTRACT

A pattern for improving aerodynamic performance of a turbine includes a material disposed in a pattern at a base surface of a turbine shroud such that the material is capable of abradable contact with a tip portion of a turbine bucket. The pattern includes a first plurality of ridges disposed at the base surface such that a first portion of the first plurality of ridges corresponding to a back portion of the turbine bucket is oriented at a first angle with respect to an axis of rotation of the turbine bucket. Each ridge of the first plurality of ridges has a first sidewall and a second sidewall having a first end and a second end. The first ends of the first and second sidewalls extend from the base surface. The first and second sidewalls slope toward each other with substantially equal but opposite slopes until meeting at the second ends of respective first and second sidewalls defining a centerline and a top portion of the ridge.

26 Claims, 6 Drawing Sheets

PATTERN FOR THE SURFACE OF A TURBINE SHROUD

BACKGROUND OF THE INVENTION

The present invention relates to patterns placed at the surface of metal components of gas turbine engines, radial inflow compressors and radial turbines, including micro-turbines and turbo-chargers, that are exposed to high temperature environments and, in particular, to a new type of optimized pattern applied to turbine shrouds used in gas turbine engines in order to improve the performance and efficiency of the turbine blades (also known as "buckets").

Gas turbine engines are used in a wide variety of different applications, most notably electrical power generation. Such engines typically include a turbocompressor that compresses air to a high pressure by means of a multi-stage axial flow compressor. The compressed air passes through a combustor, which accepts air and fuel from a fuel supply and provides continuous combustion, thus raising the temperature and pressure of the working gases to a high level. The combustor delivers the high temperature gases to the turbine, which in turn extracts work from the high-pressure gas working fluid as it expands from the high pressure developed by the compressor down to atmospheric pressure.

As the gases leave the combustor, the temperature can easily exceed the acceptable temperature limitations for the materials used in construction of the nozzles and buckets in the turbine. Although the hot gases cool as they expand, the temperature of the exhaust gases normally remains well above ambient. Thus, extensive cooling of the early stages of the turbine is essential to ensure that the components have adequate life. The high temperature in early stages of the turbine creates a variety of problems relating to the integrity, metallurgy and life expectancy of components coming in contact with the hot gas, such as the rotating buckets and turbine shroud. Although high combustion temperatures normally are desirable for a more efficient engine, the high gas temperatures may require that air be taken away from the compressor to cool the turbine parts, which tends to reduce overall engine efficiency.

In order to achieve maximum engine efficiency (and corresponding maximum electrical power generation), it is important that the buckets rotate within the turbine casing or "shroud" with minimal interference and with the highest possible efficiency relative to the amount of energy available from the expanding working fluid.

During operation, the turbine casing (shroud) remains fixed relative to the rotating buckets. Typically, the highest efficiencies can be achieved by maintaining a minimum threshold clearance between the shroud and the bucket tips to thereby prevent unwanted "leakage" of a hot gas over tip of the buckets. Increased clearances will lead to leakage problem and cause significant decreases in overall efficiency of the gas turbine engine. Only a minimum amount of "leakage" of the hot gases at the outer periphery of the buckets, i.e., the small annular space between the bucket tips and turbine shroud, can be tolerated without sacrificing engine efficiency. Further, there are losses caused by the flow of hot gas over a particular portion of an interior surface of the turbine shroud when the bucket is not near the particular portion.

The need to maintain adequate clearance without significant loss of efficiency is made more difficult by the fact that as the turbine rotates, centrifugal forces acting on the turbine components can cause the buckets to expand in an outward direction toward the shroud, particularly when influenced by the high operating temperatures. Additionally, the clearance between a bucket tip and the shroud may be non-uniform over the entire circumference of the shroud. Non-uniformity is caused by a number of factors including machining tolerances, stack up tolerances, and non-uniform expansion due to varying thermal mass and thermal response. Thus, it is important to establish the lowest effective running clearances between the shroud and bucket tips at the maximum anticipated operating temperatures.

A significant loss of gas turbine efficiency results from wear of the bucket tips if, for example, the shroud is distorted or the bucket tips rub against the ceramic or metallic flow surface of the shroud. If bucket tips rub against a particular location of the shroud such that the bucket tip is eroded, the erosion of the bucket tip increases clearances between bucket tip and shroud in other locations. Again, any such deterioration of the buckets at the interface with the shroud when the turbine rotates will eventually cause significant reductions in overall engine performance and efficiency.

In the past, abradable type coatings have been applied to the turbine shroud to help establish a minimum, i.e., optimum, running clearance between the shroud and bucket tips under steady-state temperature conditions. In particular, coatings have been applied to the surface of the shroud facing the buckets using a material that can be readily abraded by the tips of the buckets as they turn inside the shroud at high speed with little or no damage to the bucket tips. Initially, a clearance exists between the bucket tips and the coating when the gas turbine is stopped and the components are at ambient temperature. Later, during normal operation the clearance decreases due to the centrifugal forces and temperature changes in rotating and stationary components inevitably resulting in at least some radial extension of the bucket tips, causing them to contact the coating on the shroud and wear away a part of the coating to establish the minimum running clearance. Without abradable coatings, the cold clearances between the bucket tips and shroud must be large enough to prevent contact between the rotating bucket tips and the shroud during later high temperature operation. With abradable coatings, on the other hand, the cold clearances can be reduced with the assurance that if contact occurs, the sacrificial part is the abradable coating instead of the bucket tip.

As noted in prior art patents describing abradable coatings for use in turbocompressors and gas turbines (see e.g., U.S. Pat. No. 5,472,315), a number of design factors are considered in selecting an appropriate material for use as an abradable coating on the shroud, depending upon the coating composition, the specific end use, and the operating conditions of the turbine, particularly the highest anticipated working fluid temperature. Ideally, the cutting mechanism (e.g., the bucket blade tips) can be made sufficiently strong and the coating on the shroud will be brittle enough at high temperatures to be abraded without causing damage to the bucket tips themselves. That is, at the maximum operating temperature, the shroud coating should be preferentially abraded in lieu of any loss of metal on the bucket tips.

Any coating material that is removed (abraded) from the shroud, however, should not affect downstream engine components. Ideally, the abradable coating material remains bonded to the shroud for the entire operational life of the gas turbine and does not significantly degrade over time. In other words, the abradable material is securely bonded to the turbine shroud and remains bonded while portions of the coating are removed by the bucket blades during startup, shutdown or a hot-restart. Preferably, the coating should also remain secured to the shroud during a large number of operational cycles, that is, despite repeated thermal cycling of the gas turbine engine during startup and shutdown, or periodic off-loading of power.

Thus, the need exists for an improved pattern that will allow for the use of bucket tips at elevated temperatures without requiring any tip treatment (such as the application of aluminum oxide and/or abrasive grits such as cubic boron nitride). A need also exists for an improved abradable coating system that can be used if necessary in conjunction with reinforced bucket tips in order to provide even longer-term reliability and improved operating efficiency.

BRIEF DESCRIPTION OF THE INVENTION

Exemplary embodiments of the invention include a pattern for improving aerodynamic performance of a turbine including a material disposed at a base surface disposed at an interior surface of a turbine shroud such that the material is capable of abradable contact with a tip portion of a turbine bucket. The material is disposed in a pattern including a first plurality of ridges disposed at the base surface such that at least a first portion of the first plurality of ridges corresponding to at least a back portion of the turbine bucket is oriented at a first angle with respect to an axis of rotation of the turbine bucket. Each ridge of the first plurality of ridges has a first sidewall and a second sidewall. The first and second sidewalls each have a first end and an opposite second end. The first end of the first and second sidewalls extends from the base surface. The first and second sidewalls slope toward each other until meeting at the second ends of respective first and second sidewalls defining a centerline and a top portion of the ridge. The first and second sidewalls are inclined with substantially equal but opposite slopes with respect to the base surface.

Further exemplary embodiments of the invention include a pattern for improving aerodynamic performance of a turbine including a first plurality of ridges disposed at a base surface disposed at an interior surface of a turbine shroud such that at least a first portion of the first plurality of ridges corresponding to at least a back portion of a turbine bucket is oriented at a first angle with respect to an axis of rotation of the turbine bucket. Each ridge of the first plurality of ridges has a first sidewall and a second sidewall. The first and second sidewalls each have a first end and an opposite second end. The first end of the first and second sidewalls extends from the base surface. The first and second sidewalls are disposed substantially perpendicular to the base surface. The second ends of respective first and second sidewalls are connected by a top portion of the ridge.

Further exemplary embodiments of the invention include a turbine casing including a turbine shroud and a material disposed at a base surface disposed at an interior surface of a turbine shroud such that the material is capable of abradable contact with a tip portion of a turbine bucket. The material is disposed in a pattern including a first plurality of ridges disposed at the base surface such that at least a first portion of the first plurality of ridges corresponding to at least a back portion of the turbine bucket is oriented at a first angle with respect to an axis of rotation of the turbine bucket. Each ridge of the first plurality of ridges has a first sidewall and a second sidewall. The first and second sidewalls each have a first end and an opposite second end. The first end of the first and second sidewalls extends from the base surface. The first and second sidewalls slope toward each other until meeting at the second ends of respective first and second sidewalls defining a centerline and a top portion of the ridge. The first and second sidewalls are inclined with substantially equal but opposite slopes with respect to the base surface.

Further exemplary embodiments of the invention include a turbine including a rotatable shaft, a turbine shroud, and a material disposed at a base surface disposed at an interior surface of a turbine shroud such that the material is capable of abradable contact with a tip portion of a turbine bucket. The material is disposed in a pattern including a first plurality of ridges disposed at the base surface such that at least a first portion of the first plurality of ridges corresponding to at least a back portion of the turbine bucket is oriented at a first angle with respect to an axis of rotation of the turbine bucket. Each ridge of the first plurality of ridges has a first sidewall and a second sidewall. The first and second sidewalls each have a first end and an opposite second end. The first end of the first and second sidewalls extends from the base surface. The first and second sidewalls slope toward each other until meeting at the second ends of respective first and second sidewalls defining a centerline and a top portion of the ridge. The first and second sidewalls are inclined with substantially equal but opposite slopes with respect to the base surface.

The above, and other objects, features and advantages of the present invention will become apparent from the following description read in conjunction with the accompanying drawings, in which like reference numerals designate the same elements.

BRIEF DESCRIPTION OF THE DRAWINGS

Referring now to the drawings wherein like elements are numbered alike in the several FIGURES.

DETAILED DESCRIPTION OF THE INVENTION

Figure 1:
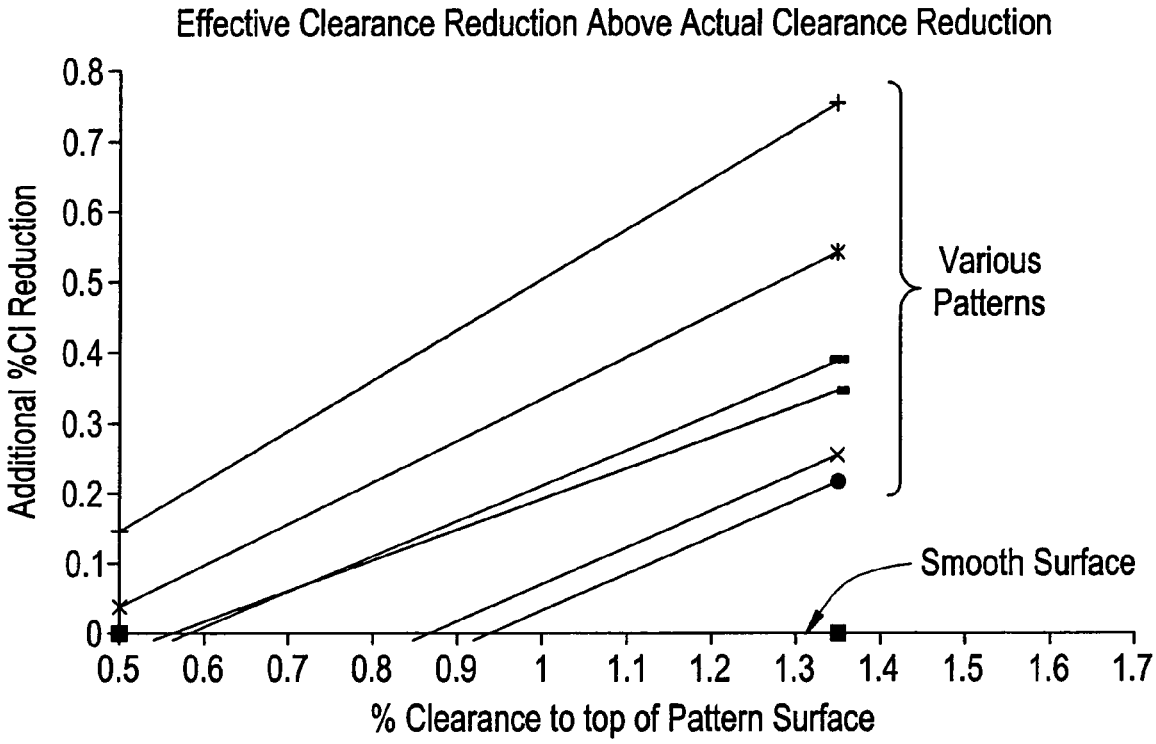
FIG. 1 is a graph showing the improvement in aerodynamic performance of a turbine due to the presence of a pattern over and above a decrease in a clearance between a turbine bucket tip and an interior surface of a turbine shroud.

Exemplary embodiments of the present invention include an abradable coating defining a pattern that improves abradability of an abradable material and improves the aerodynamic performance of a turbine by improving a seal around a turbine bucket tip. Another exemplary embodiment includes the pattern formed in an interior surface of a turbine shroud. Generally, the pattern is formed from a plurality of ridges. Exemplary embodiments of the pattern improve aerodynamic performance of the turbine by decreasing a space between the turbine bucket tip and a turbine shroud, thereby improving the seal around the turbine bucket tip. An additional aerodynamic performance improvement is realized due to the pattern reducing aerodynamic losses between each turbine bucket tip of a plurality of turbine bucket tips. A patterned surface on the interior surface of the turbine shroud provides a direction to the mainstream flow on the outer wall. Thus, even if the seal were not improved, the patterned surface reduces aerodynamic losses. FIG. 1 is a graph illustrating the aerodynamic benefit of various alternative embodiments of the improved pattern. As shown in FIG. 1, there is a decrease in the effective clearance between the turbine bucket tip and the interior surface of the turbine shroud by disposing the pattern on the interior surface of the turbine shroud over and above any actual decrease in clearance caused by a presence of the pattern. An exemplary embodiment of the pattern also improves abradability by reducing the volume of abradable coating which must be removed during rubbing with the turbine bucket tip. Improved abradability of the pattern results in less erosion of the turbine bucket tip, thereby eliminating the need to treat each turbine bucket tip to reduce such erosion thereof.

Figure 2:
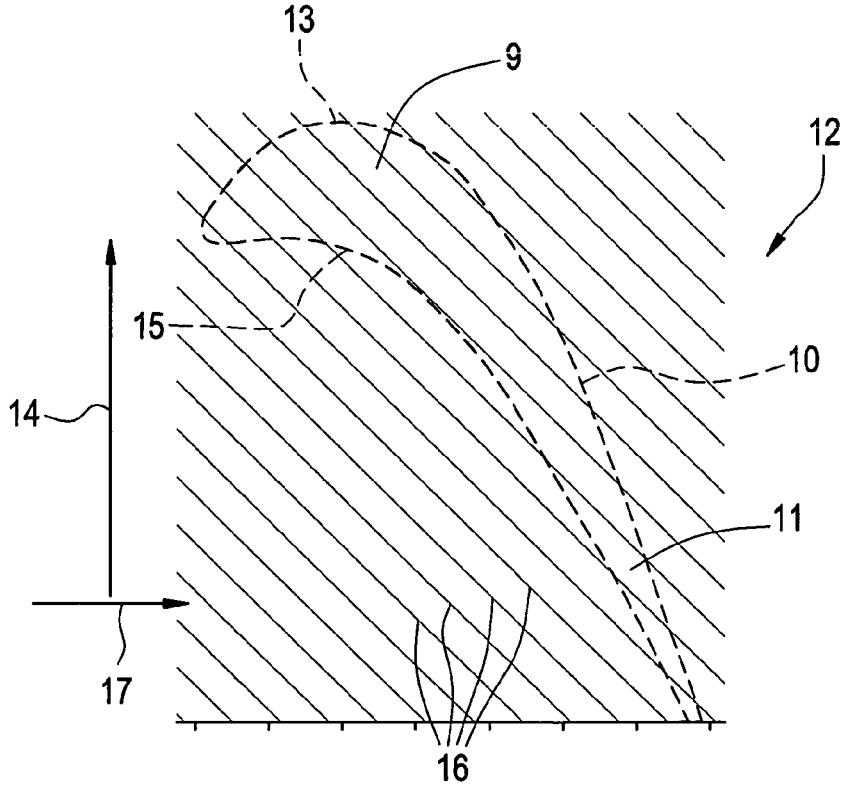
FIG. 2 is a plan view of an abradable pattern showing the outline of the outer surface of a turbine bucket tip with phantom lines in contact with the abradable pattern in accordance with an exemplary embodiment.

FIG. 2 is a view of an exemplary embodiment of an abradable pattern 12 showing a contact patch. The contact patch is an outline of the outer surface of a turbine bucket tip 10 with phantom lines in contact with the abradable pattern 12. Arrow 14 shows a direction of translation of the turbine bucket tip 10 with respect to the abradable pattern 12. In an exemplary embodiment, the translation of the turbine bucket tip 10 is caused by a rotation of the turbine bucket tip 10. Arrow 17 indicates a direction of a fluid flow with respect to the abradable pattern 12. Turbine bucket tip 10 comprises a front portion 9 and a back portion 11. Front portion 9 is a portion of the turbine bucket tip 10, which receives the fluid flow first in a blade row during turbine operation. Front portion 9 of the turbine bucket tip 10 is curved in a direction opposite the direction of translation 14 to improve aerodynamic characteristics of the turbine bucket tip 10. A leading surface 13 is a surface of the turbine bucket tip 10 which is in front of the turbine bucket tip 10 with respect to the direction of translation 14, when the turbine bucket tip 10 rotates during normal operation. A trailing surface 15 is a surface of the turbine bucket tip 10 which is in back of the leading surface 13 of the turbine bucket tip 10 with respect to the direction of translation 14, when the turbine bucket tip 10 rotates during normal operation. Back portion 11 is a portion of the turbine bucket tip 10, which follows the front portion 11 with respect to the direction of translation 14, when the turbine bucket tip 10 rotates during normal operation.

Abradable pattern 12 is defined by a first plurality of ridges 16 disposed on a base surface 20. Each ridge 16 of the plurality of ridges 16 is substantially parallel with each other ridge 16. Each ridge 16 of the plurality of ridges 16 is also substantially equidistant from each other ridge 16.

Figure 3:
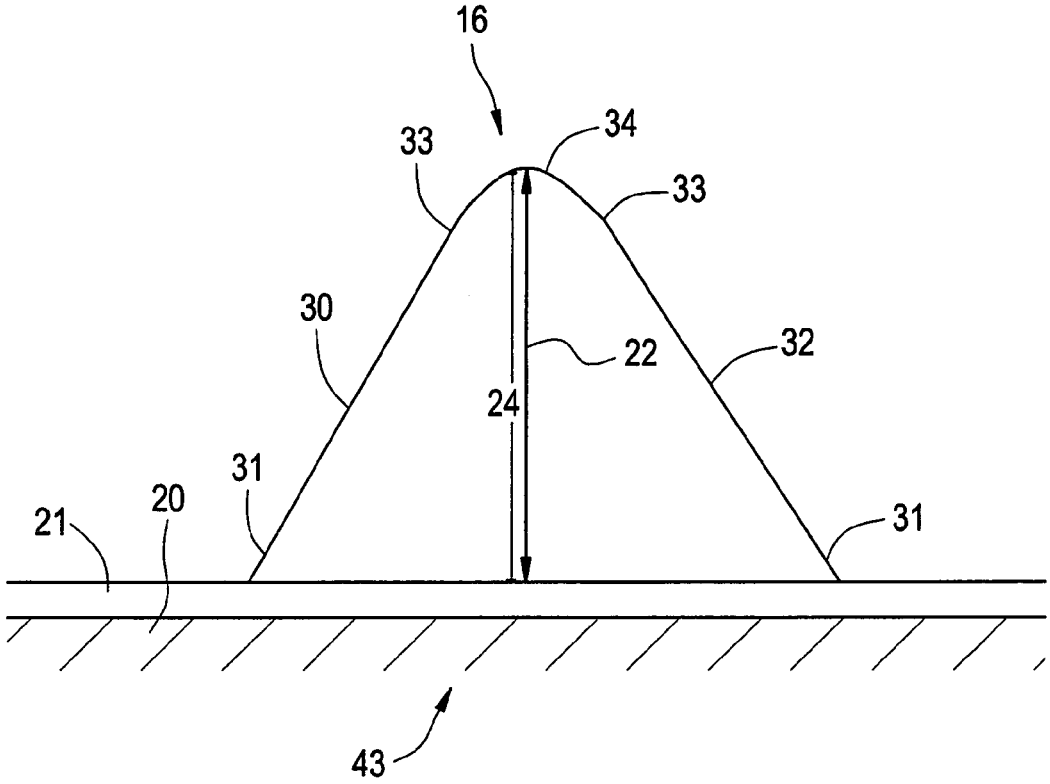
FIG. 3 is a cross section view of a ridge defining an exemplary embodiment of the abradable pattern.

FIG. 3 shows a cross section view of one ridge 16 from the first plurality of ridges 16 in an exemplary embodiment. Ridge 16 is disposed on the base surface 20. In an exemplary embodiment, base surface 20 is disposed at an interior surface of the turbine shroud 43, however, base surface 20 is not limited thereto and includes other suitable surfaces. Base surface 20 includes a thermal barrier coating applied to the interior surface of the turbine shroud 43, a metallic coating applied to the interior surface of the turbine shroud 43, or an exposed inner surface of the turbine shroud, for example. The exposed inner surface of the turbine shroud includes but is not limited to a metallic and a ceramic surface. The thermal barrier coating includes for example, barium strontium aluminosilicate or zirconia, either partially or fully stabilized with yttria, magnesia, calcia, or other stabilizers. The metallic coating includes, for example, MCrAlY, where M=Nickel (Ni), Cobalt (Co), Iron (Fe) or some combination thereof, or inter-metallic of Beta-NiAl. The base surface 20 is optionally covered in a layer of abradable coating 21. If the layer of abradable coating 21 is used, the layer is up to about 0.32 mm in height from base surface 20. Ridge 16 has a centerline 22 and a ridge height 24. The ridge height 24 at the centerline 22 is measured from the base surface 20 to a top portion 34. If the layer of abradable coating 21 is used, ridge height 24 is measured from an outer surface of the layer of abradable coating 21 to the top portion 34. The ridge height 24 of each ridge 16 is equal to the ridge height 24 of each other ridge 16 in the first plurality of ridges 16. The ridge height 24 ranges from about 0.25 mm to about 2.5 mm. Each ridge 16 is defined by a first sidewall 30 and a second sidewall 32. First and second sidewalls 30 and 32 are defined by a first end 31 and a second end 33. First ends 31 of both first and second sidewalls 30 and 32 are disposed in contact with the base surface 20 and extended therefrom. Second ends 33 of both first and second sidewalls 30 and 32 join together and define the top portion 34. First and second sidewalls 30 and 32 are disposed such that first and second sidewalls 30 and 32 slope towards each other as they extend from base surface 20. Bisecting ridge 16 at top portion 34 corresponds with the centerline 22 of each ridge 16. First and second sidewalls 30 and 32 slope toward the centerline 22 with substantially equal, but opposite, slopes with respect to the base surface 20. The shape of the top portion 34 may be substantially curved, corresponding to connecting second ends of respective first and second sidewalls 30 and 32 as illustrated, or defines two sides of a triangle when seen in a cross section view.

Figure 4:
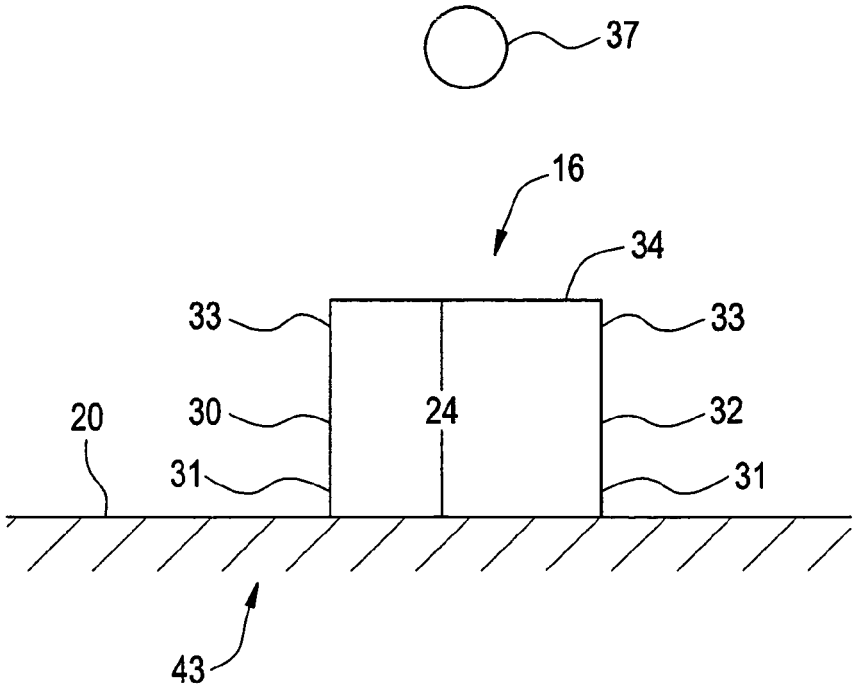
FIG. 4 is a cross section view of a ridge defining an exemplary embodiment of a pattern.

FIG. 4. shows an alternative exemplary embodiment in which the first and second sidewalls 30 and 32 are disposed as described above except that first and second sidewall are substantially perpendicular to the base surface 20. The top portion 34 connects second ends 33 of each of first and second sidewalls 30 and 32. The shape of the top portion 34 is flat and the top portion 34 is substantially parallel to the base surface 20. In an alternative exemplary embodiment, where the base surface 20 is the metallic or the ceramic interior surface of the shroud, the base surface 20 and the ridge 16 are unitary. The plurality of ridges 16 in this exemplary embodiment is machined into the interior surface of the turbine shroud 43. In other words, the interior surface of the shroud 43 and the plurality of ridges are unitary. Although the plurality of ridges 16 is machined in an exemplary embodiment, it is understood that any method of forming ridges in the metallic or the ceramic interior surface of the shroud is contemplated.

Figure 5:
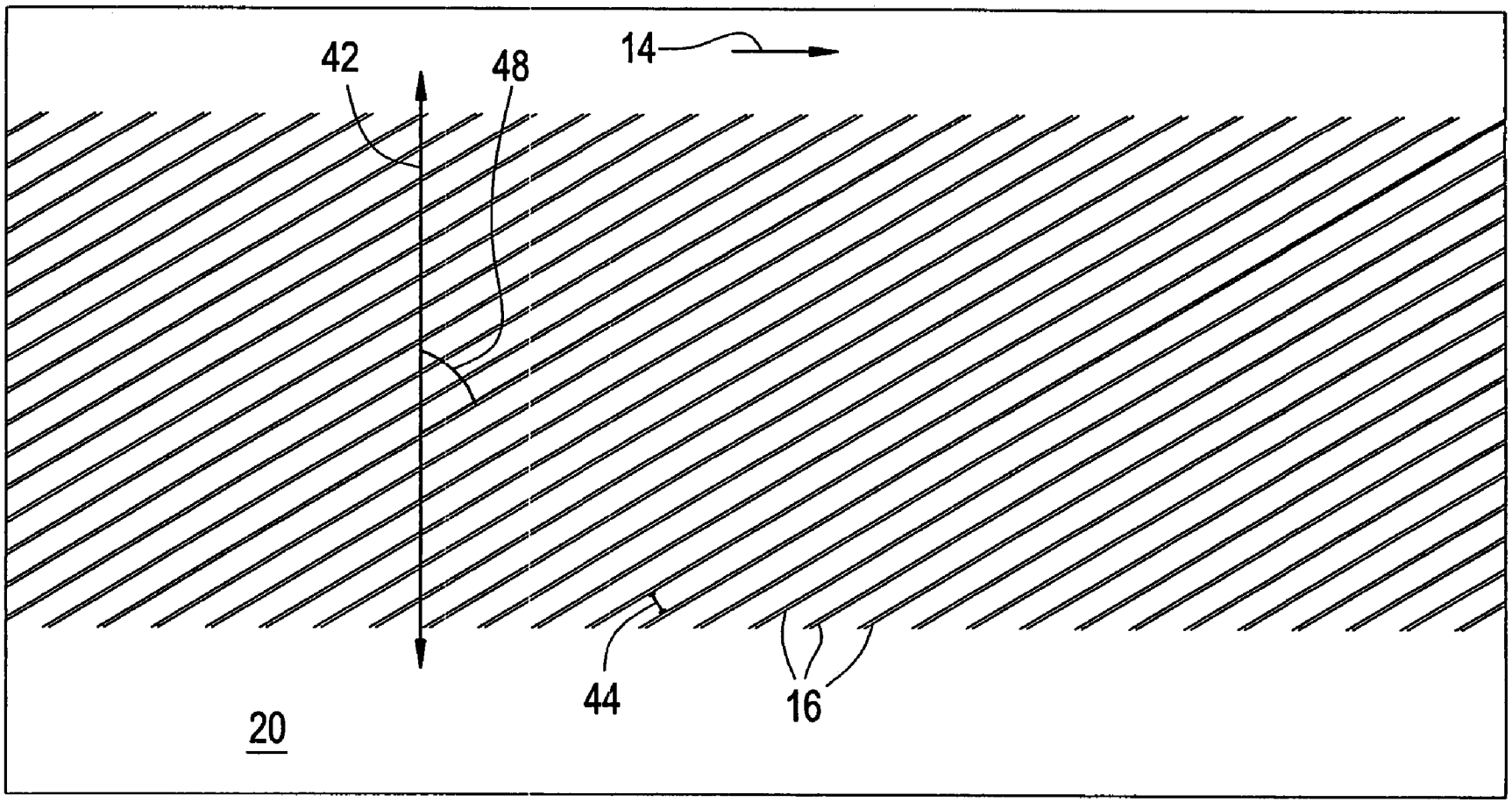
FIG. 5 is a plan view of a base surface having the abradable pattern in which the pattern is a plurality of parallel ridges in accordance with an exemplary embodiment.

FIG. 5 shows an exemplary embodiment of an abradable pattern in which the first plurality of ridges 16 is disposed in a pattern of parallel lines similar to those of FIG. 2. Arrow 14 indicates a direction of translation of the turbine bucket tip 10 (FIG. 2) with respect to the first plurality of ridges 16. A reference line 42 on the interior surface of the turbine shroud 43 representative of an axis of rotation of the turbine bucket (not shown) as is shown by a double-arrow. The turbine bucket rotates around a rotatable shaft indicated generally at 37 in FIG. 4. In an exemplary embodiment, the base surface 20 may be the interior surface of the turbine shroud 43. Although the turbine shroud is substantially cylindrical in shape, it is displayed herein as a flat surface for the sake of clarity. The first plurality of ridges 16 is disposed such that each ridge 16 is substantially parallel to each other ridge 16 of the first plurality of ridges 16. Each ridge 16 is also disposed such that there is an equal distance between each other ridge 16. A distance 44 between each ridge 16 ranges between about 3.6 mm to about 7.1 mm. Each ridge 16 is further disposed such that a first angle 48 is formed with respect to the reference line 42. First angle 48 ranges from about 20 degrees to about 70 degrees.

Figure 6:
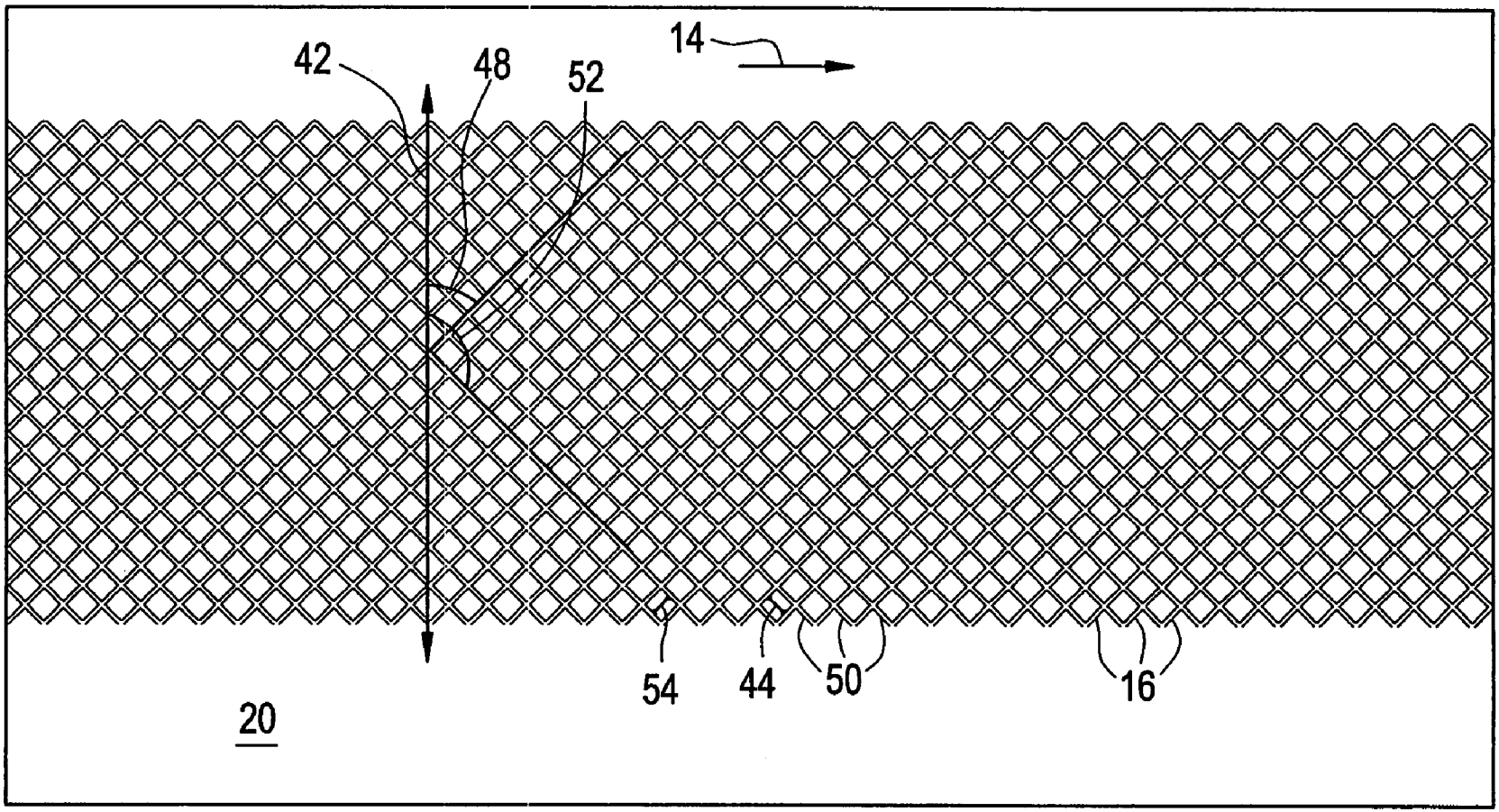
FIG. 6 is a plan view of the base surface having an abradable pattern in which the pattern is a first plurality of parallel ridges intersecting a second plurality of parallel ridges to form a diamond shape.

FIG. 6 shows an alternative exemplary embodiment in which the first plurality of ridges 16 disposed at the first angle 48 with respect to the reference line 42, intersect a second plurality of ridges 50 disposed at a second angle 52 with respect to the reference line 42. The pattern formed by the intersection of first and second plurality of ridges 16 and 50 is a diamond pattern. In this embodiment, arrow 14 shows a direction of translation of the turbine bucket tip 10 with respect to the first and second plurality of ridges 16 and 50. The first plurality of ridges 16 is disposed such that each ridge 16 of the first plurality of ridges 16 is substantially parallel to each other ridge 16 of the first plurality of ridges 16 as in FIGS. 2 and 5. Each ridge 16 of the first plurality of ridges 16 is also disposed such that there is an equal distance between each ridge 16. Distance 44 between contiguous ridges 16 ranges between about 3.6 mm to about 7.1 mm. Each ridge 50 is substantially parallel to each other ridge 50. Each ridge 50 is also disposed such that there is an equal distance between contiguous ridges 50. A distance 54 between each ridge 50 ranges between about 3.6 mm to about 7.1 mm. It will be recognized that distances 44 and 54 between each ridge 16 and each ridge 50 are substantially equal to each other in the diamond pattern of FIG. 6. The second plurality of ridges 50 is disposed such that each ridge forms the second angle 52 with respect to the reference line 42. Second angle 52 is different than first angle 48. In an exemplary embodiment, second angle 52 is complementary to first angle 48.

Figure 7:
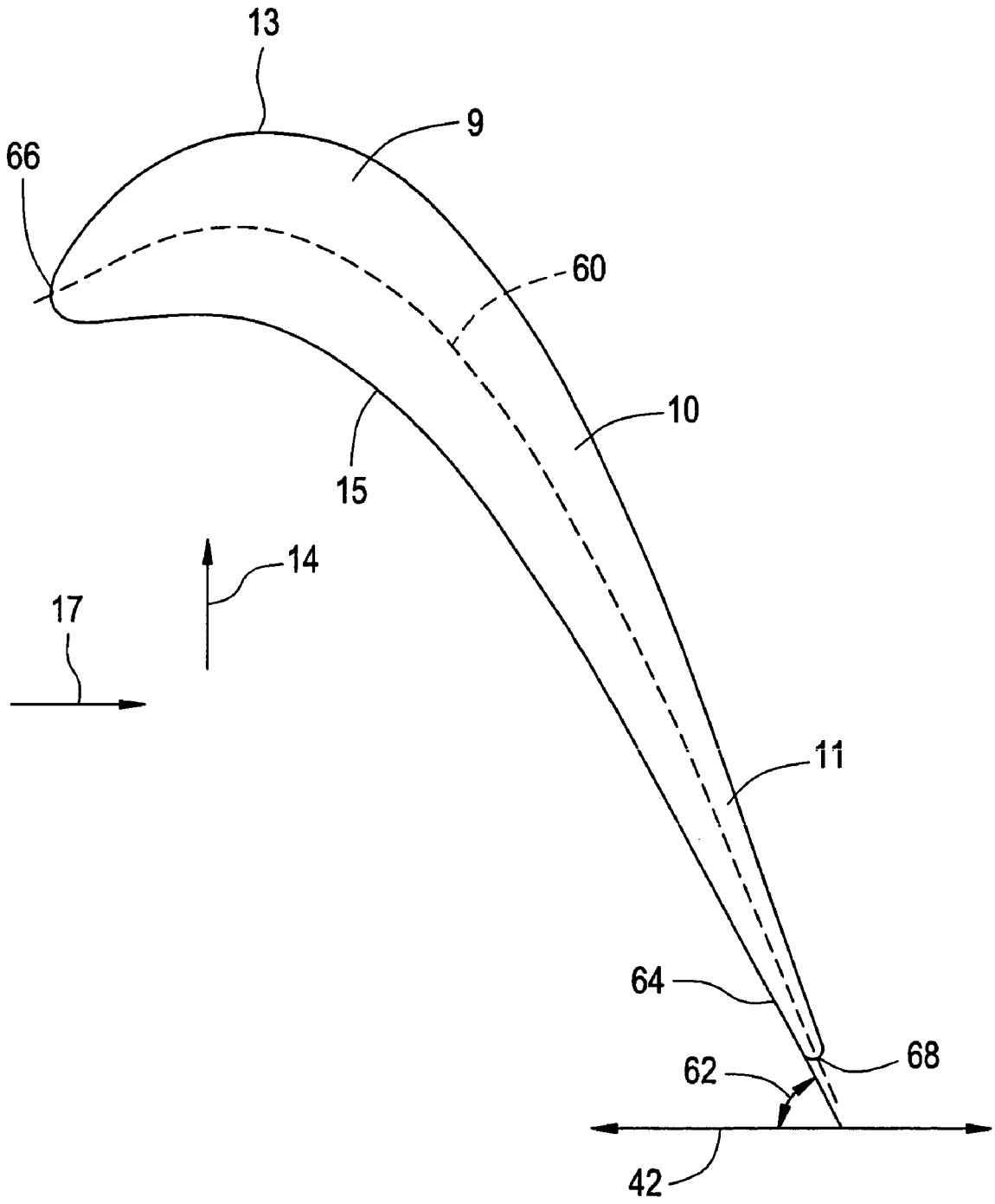
FIG. 7 shows a mean camber line through a cross section of a turbine bucket.

FIG. 7 shows a mean camber line 60 through a cross section of the turbine bucket corresponding to a turbine bucket tip 10. The mean camber line is an imaginary line that lies halfway between the leading surface 13 and the trailing surface 15 of the turbine bucket tip 10. The mean camber line 60 has a first end 66 and a second end 68. Arrow 14 shows a direction of translation of the turbine bucket tip 10 with respect to the first plurality of ridges 16. Arrow 17 indicates the direction of the fluid flow with respect to the bucket tip 10. The mean camber line 60 is a substantially curved shape near the front portion 9 of the turbine bucket tip 10, and the mean camber line 60 is substantially straight near the back portion 11 of the turbine bucket tip 10. The substantially curved shape of the mean camber line 60 includes a bend in a direction opposite the direction of translation 14. The bend increases in turning radius as the first end 66 is approached from the second end 68. The mean camber line 60 extends through the turbine bucket tip 10 from first end 66 to second end 68. An exit angle 62 is formed between the reference line 42 and a trailing edge 64 portion of the trailing surface 15 of the turbine bucket tip 10. The trailing edge 64 corresponds to the back portion 11 near the second end 68. In an exemplary embodiment, the first angle 48 (see FIGS. 5 and 6) of each ridge 16 is selected to match the exit angle 62.

Figure 8:
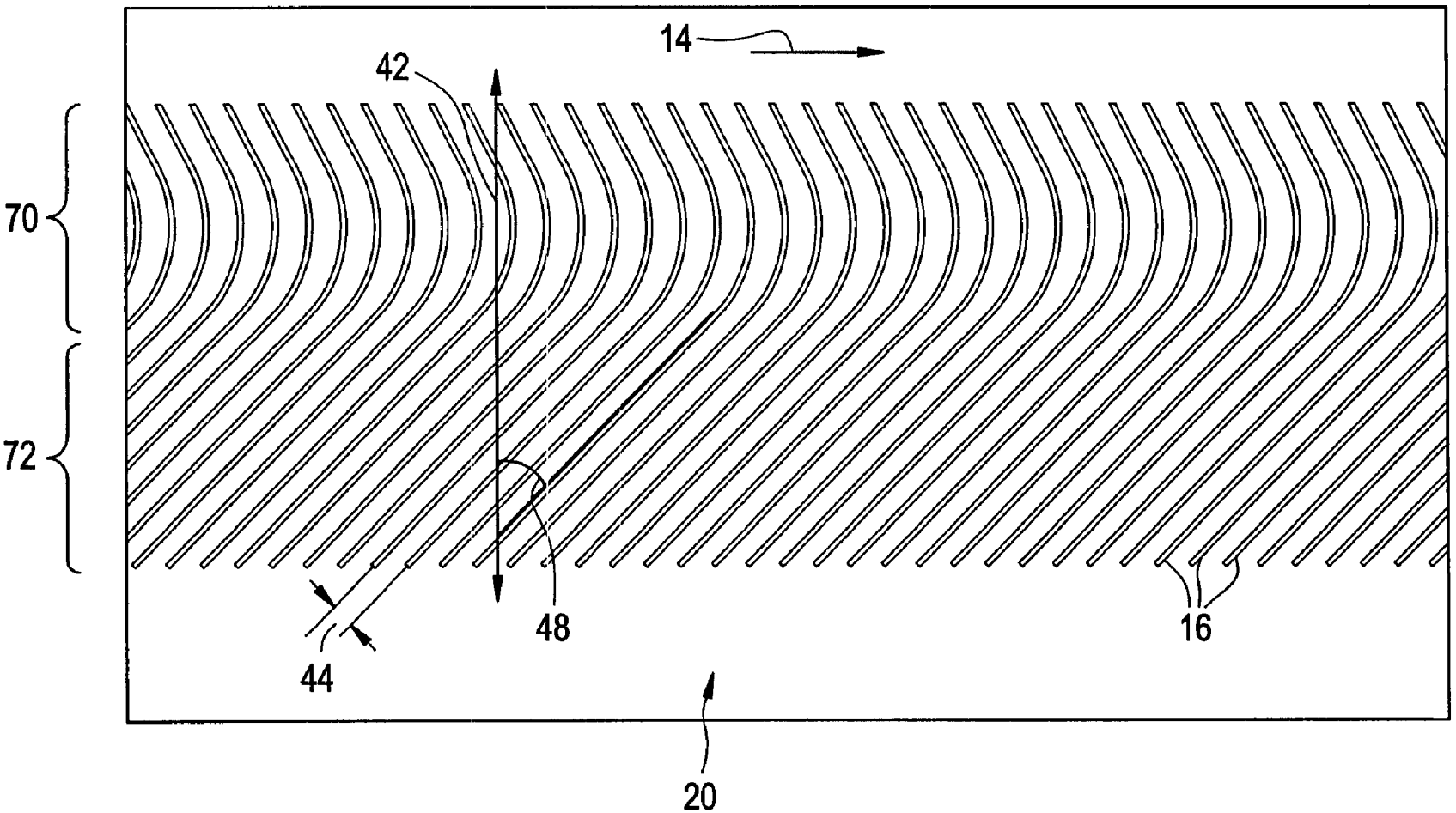
FIG. 8 is a plan view of the base surface having an abradable pattern in which the pattern is parallel lines, which are bent to a mean camber line at a portion of the pattern corresponding to a front portion of a turbine bucket.

FIG. 8 shows a view of an alternative exemplary embodiment of a pattern for an abradable coating defining a first plurality of ridges 16. The pattern includes a curved section 70 and a straight section 72. The curved section 70 is disposed at a portion of the pattern corresponding to the front portion 9 of the turbine bucket tip 10 when the turbine bucket tip 10 is in abradable communication with the pattern. The straight section 72 is disposed at a portion of the ridges 16 corresponding to the back portion 11 of the turbine bucket tip 10 when the turbine bucket tip 10 is in abradable communication with the pattern. The straight section 72 is at a first end of the ridges 16. The first plurality of ridges 16 are disposed on the base surface 20 such that each ridge 16 of the first plurality of ridges 16 is substantially parallel to each other ridge 16 in the straight section 72. Each ridge 16 is also disposed such that there is an equal distance between contiguous ridges 16 in both the curved and the straight sections 70 and 72. A distance 44 between each ridge 16 ranges between about 3.6 mm to about 7.1 mm. The first plurality of ridges 16 is disposed in the straight section 72 such that first angle 48 is formed with respect to the reference line 42. First angle 48 ranges from about 20 degrees to about 70 degrees. In an exemplary embodiment, first angle 48 is selected to match the exit angle 62 (see FIG. 7). The curved section 70 includes a radius configured to substantially match a mean camber line 60 shape through the curved section 70.

In addition, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A pattern for improving aerodynamic performance of a turbine comprising:

a material disposed at a base surface disposed at an interior surface of a turbine shroud such that said material is capable of abradable contact with a tip portion of a turbine bucket, said material disposed in a pattern, wherein said pattern comprises, a first plurality of ridges disposed at said base surface such that at least a first portion of said first plurality of ridges corresponding to at least a back portion of said turbine bucket is oriented at a first angle with respect to an axis of rotation of said turbine bucket, each ridge of said first plurality of ridges defined by a first sidewall and a second sidewall, said first and second sidewalls each having a first end and an opposite second end, said first end of said first and second sidewalls extending from said base surface, said first and second sidewalls sloping toward each other until meeting at said second ends of respective first and second sidewalls defining a centerline and a top portion of said ridge, said first and second sidewalls are inclined with substantially equal but opposite slopes with respect to said base surface, wherein said first plurality of ridges extends to a second portion of said first plurality of ridges corresponding to a front portion of said turbine bucket, said second portion defining a curved section of said first plurality of ridges.

2. The pattern of claim 1, wherein said each ridge of said first plurality of ridges is equally spaced apart from each other by about 3.6 mm to about 7.1 mm.

3. The pattern of claim 1, wherein a height of said each ridge ranges from about 0.25 mm to about 2.5 mm as measured vertically from said base surface to said top portion.

4. The pattern of claim 1, wherein said first angle ranges from about 20 degrees to about 70 degrees.

5. The pattern of claim 4, wherein said pattern includes said first plurality of ridges disposed at said base surface such that said each ridge of said first plurality of ridges is substantially parallel to each other.

6. The pattern of claim 5, wherein said first angle is equal to an exit angle of a trailing edge of said turbine bucket.

7. The pattern of claim 5, wherein a second plurality of ridges is disposed at said base surface at a second angle with respect to said axis of rotation of said turbine bucket such that first and second plurality of ridges intersect, and said second angle is different than said first angle.

8. The pattern of claim 1, wherein said curved section comprises said first plurality of ridges disposed such that said ridges bend substantially corresponding to a mean camber line shape of said turbine bucket.

9. The pattern of claim 8, wherein said first angle is equal to said exit angle of said trailing edge of said turbine bucket.

10. The pattern of claim 1, wherein said base surface includes at least one of:

a thermal barrier coating;

a metallic coating; and a surface of said turbine shroud, said surface of said turbine shroud being at least one of metallic and ceramic.

11. The pattern of claim 10, wherein said thermal barrier coating comprises at least one of:

a barium strontium aluminosilicate;

a yttria stabilized zirconia;

a magnesia stabilized zirconia; and a calcia stabilized zirconia.

12. The pattern of claim 10, wherein said metallic coating comprises at least one of:

an inter-metallic of Beta-NiAl; and a MCrAlY, said M comprises at least one of nickel, cobalt, iron and a combination of any of nickel, cobalt and iron.

13. The pattern of claim 1, wherein said first plurality of ridges are configured such that said tip portion of said turbine bucket is resistant to erosion during translational contact therebetween.

14. The pattern of claim 1, wherein said material comprises at least one of:

a ceramic coating;

a ceramic surface of the turbine shroud; and a metallic surface of the turbine shroud.

15. A pattern for improving aerodynamic performance of a turbine, the pattern comprising:

a first plurality of ridges disposed at a base surface disposed at an interior surface of a turbine shroud such that at least a first portion of said first plurality of ridges corresponding to at least a back portion of a turbine bucket is oriented at a first angle with respect to an axis of rotation of said turbine bucket, wherein said first plurality of ridges extends to a second portion of said first plurality of ridges corresponding to a front portion of said turbine bucket, said second portion defining a curved section of said first plurality of ridges, said curved section comprises said first plurality of ridges disposed such that said ridges bend substantially corresponding to a mean camber line shape of said turbine bucket each ridge of said first plurality of ridges having a first sidewall and a second sidewall, said first and second sidewalls each having a first end and an opposite second end, said first end of said first and second sidewalls extending from said base surface, said first and second sidewalls disposed substantially perpendicular to said base surface, said second ends of respective first and second sidewalls are connected by a top portion of said ridge.

16. The pattern of claim 15, wherein said first plurality of ridges and said interior surface of said turbine shroud are unitary.

17. The pattern of claim 15, wherein a machining of said turbine shroud forms said pattern.

18. The pattern of claim 15, wherein said pattern includes said first plurality of ridges disposed at said base surface such that said each ridge of said first plurality of ridges is substantially parallel to each other.

19. A turbine comprising:

a rotatable shaft;

a turbine shroud;

an material disposed at a base surface disposed at an interior surface of said turbine shroud such that said material is capable of abradable contact with a tip portion of a turbine bucket, said material disposed in a pattern, wherein said pattern comprises, a first plurality of ridges disposed at said base surface such that at least a first portion of said first plurality of ridges corresponding to at least a back portion of said turbine bucket is oriented at a first angle with respect to an axis of rotation of said turbine bucket, each ridge of said first plurality of ridges defined by a first sidewall and a second sidewall, said first and second sidewalls each having a first end and an opposite second end, said first end of said first and second sidewalls extending from said base surface, said first and second sidewalls sloping toward each other until meeting at said second ends of respective first and second sidewalls defining a centerline and a top portion of said ridge, said first and second sidewalls are inclined with substantially equal but opposite slopes with respect to said base surface wherein said first plurality of ridges extends to a second portion of said first plurality of ridges corresponding to a front portion of said turbine bucket, said second portion defining a curved section of said first plurality of ridges, said curved section comprises said first plurality of ridges disposed such that said ridges bend substantially corresponding to a mean camber line shape of said turbine bucket.

20. The turbine of claim 19, wherein said each ridge of said first plurality of ridges is equally spaced apart from each other by about 3.6 mm to about 7.1 mm.

21. The turbine of claim 19, wherein a height of said each ridge ranges from about 0.25 mm to about 2.5 mm as measured vertically from said base surface to said top portion.

22. The turbine of claim 19, wherein said first angle ranges from about 20 to about 70 degrees.

23. The turbine of claim 22, wherein said pattern includes said first plurality of ridges disposed at said base surface such that said each ridge of said first plurality of ridges is substantially parallel to each other.

24. The turbine of claim 23, wherein a second plurality of ridges is disposed at said base surface at a second angle with respect to said axis of rotation of said turbine bucket such that said first and second plurality of ridges intersect, and said second angle is larger than said first angle.

25. The turbine of claim 19, wherein said first plurality of ridges are configured such that said tip portion of said turbine bucket is resistant to erosion during translational contact therebetween.

26. A pattern for improving aerodynamic performance of a turbine comprising:

a material disposed at a base surface disposed at an interior surface of a turbine shroud such that said material is capable of abradable contact with a tip portion of a turbine bucket, said material disposed in a pattern, wherein said pattern comprises, a first plurality of ridges disposed at said base surface such that at least a first portion of said first plurality of ridges corresponding to at least a back portion of said turbine bucket is oriented at a first angle with respect to an axis of rotation of said turbine bucket, each ridge of said first plurality of ridges defined by a first sidewall and a second sidewall, said first and second sidewalls each having a first end and an opposite second end, said first end of said first and second sidewalls extending from said base surface, said first and second sidewalls sloping toward each other until meeting at said second ends of respective first and second sidewalls defining a centerline and a top portion of said ridge, said first and second sidewalls are inclined with substantially equal but opposite slopes with respect to said base surface, wherein said first angle ranges from about 20 degrees to about 70 degrees, wherein said pattern includes said first plurality of ridges disposed at said base surface such that said each ridge of said first plurality of ridges is substantially parallel to each other, wherein said first angle is equal to an exit angle of a trailing edge of said turbine bucket.

* * * * *